United States Patent [19]

Bhalla

[11] 4,291,250

[45] * Sep. 22, 1981

[54] ARC DISCHARGE TUBE END SEAL

[75] Inventor: Ranbir S. Bhalla, Pine Brook, N.J.

[73] Assignee: Westinghouse Electric Corp., Pittsburgh, Pa.

[ * ] Notice: The portion of the term of this patent subsequent to Jul. 25, 1995, has been disclaimed.

[21] Appl. No.: 36,948

[22] Filed: May 7, 1979

[51] Int. Cl.[3] ..... H01J 61/30; H01J 61/36

[52] U.S. Cl. ..... 313/220; 313/221

[58] Field of Search ..... 313/220, 221

[56] References Cited

U.S. PATENT DOCUMENTS

| | | | |
|---|---|---|---|
| 3,281,309 | 10/1966 | Ross | 313/221 X |
| 3,448,319 | 6/1969 | Louden | 313/221 |
| 3,469,729 | 9/1969 | Grekila et al. | 220/2.3 |
| 3,588,577 | 6/1971 | McVey et al. | 313/221 X |
| 3,598,435 | 8/1971 | Jorgensen | 313/221 X |
| 3,974,410 | 8/1976 | Akutsu et al. | 313/221 X |
| 4,103,200 | 7/1978 | Bhalla | 313/221 |

*Primary Examiner*—Palmer C. Demeo

*Attorney, Agent, or Firm*—B. R. Studebaker

[57] ABSTRACT

An improved arc tube end seal and the method of forming that seal in a high pressure sodium discharge lamp is disclosed. The method includes precoating the refractory metal end cap with a slurry of a mixture of refractory metal powder and powdered metallic silicon and baking the end cap prior to accomplishing the bonding of the end cap to the arc tube with a conventional sealing frit.

7 Claims, 5 Drawing Figures

ARC DISCHARGE TUBE END SEAL

BACKGROUND OF THE INVENTION

The high pressure sodium discharge lamp with its highly efficient golden-yellow discharge has made a tremendous impact on city street and highway lighting. One of the most critical operations in the manufacture of a high pressure sodium discharge lamp is the sealing of the refractory metal end caps to the polycrystalline alumina or sapphire arc tube body. Additionally, most early lamp failures can be traced to a breakdown of the seal between the arc tube and its end caps, and can, in many cases, be further identified as a failure of the bond between the sealing frit and the end cap at their interface.

Commercial high pressure sodium discharge lamps employ a glassy sealing frit to bond the arc tube body to the refractory metal end caps, and that glassy sealing frit in almost all instances principally comprises aluminum oxide and calcium oxide in about eutectic proportions. Most of these sealing frits generally include small quantities of other metallic oxides such as silicon dioxide, magnesium oxide, barium oxide, yttrium oxide, etc. Several of these sealing compositions along with the method by which the polycrystalline alumina arc tube is bonded to the refractory metal end cap in the high pressure sodium discharge lamp are disclosed in U.S. Pat. No. 3,281,309 to J. F. Ross; U.S. Pat. No. 3,469,729 to R. B. Grekila et al.; and U.S. Pat. No. 3,588,577 to Charles I. McVey et al. The inadequacies of the bond between the sealing glass frit and the refractory metal end cap has been previously recognized and efforts have been continuing to solve this problem. One attempt at a solution is disclosed in U.S. Pat. No. 3,448,319 to W. C. Louden in which a suspension of tungsten trioxide in a suitable binder mixed with a minor proportion of the sealing composition was coated on the interior surface of the end cap. In that process, great care had to be taken to assure that the tungsten layer was completely overcoated with a layer of ceramic sealing material so that none of the tungsten would be exposed to the alkaline metal vapor in the arc tube. U.S. Pat. No. 3,598,435 to Paul J. Jorgensen discloses a process wherein zirconium dioxide is formed on the niobium by coating the refractory metal with zirconium hydride or alternatively employing zirconium oxide or a zirconium rich niobium alloy by diffusion of zirconium into the niobium surface. The use of zirconium however, is believed to cause undesirable embrittlement of the niobium end cap.

More recently, the use of an end cap internal pre-coat of metallic silicon was disclosed in U.S. Pat. No. 4,103,200, issued July 25, 1978 to R. S. Bhalla, which significantly improved the bond between the refractory metal end caps and the calcia-alumina sealing frit. The end cap seal and method of this invention is a further improvement over the seal of that invention.

Furthermore, it has been found that the seal between the arc tube body and the end cap can be a critical factor in the operation of high pressure sodium discharge lamps at the higher temperatures required to produce an improved light source for purposes of color rendition of illuminated objects. Such a lamp is disclosed in application Ser. No. 923,597, filed July 11, 1978, by the instant inventor and owned by the assignee of this invention.

SUMMARY OF THE INVENTION

The foregoing problems with respect to sealing refractory metals to alumina ceramics have been obviated in accordance with the present invention by providing a thin coating or layer of a mixture of refractory metal powder and powdered silicon between the refractory metal and the calcia-alumina sealing frit.

The refractory metal end caps, preferably niobium, are coated with a slurry which principally comprises a mixture of a refractory metal powder, preferably niobium and powdered silicon and a vehicle. The ratio of niobium metal powder to silicon metal powder is preferably 3 to 7. This coating is applied in an amount from between about 1.8 to 6.0 milligrams per square centimeter of surface and may be deposited by either painting or spraying. The coated refractory metal is then baked for a predetermined time at a predetermined temperature to produce a refractory metal silicide coating. A conventional glass sealing frit which principally comprises aluminum oxide and calcium oxide is then applied to the interface of the alumina ceramic and refractory metal and sealed by means of a conventional heating schedule.

It has been found that the coating forms a strong chemically reactive bond with both the niobium metal end cap and the oxide frit when a thin layer of the coating is used as an intermediate layer to form in essence a niobium refractory metal silicide-frit, graded seal.

This invention produces a sealed high pressure sodium discharge lamp arc tube which includes an elongated alumina arc tube body and a pair of refractory metal end caps associated with the ends of the arc tube body, and means sealing the end caps to the arc tube body which includes a coating of a refractory metal silicide on the interior surface of the refractory metal end cap and a glassy sealing frit principally comprising alumina and calcia interposed between the refractory metal silicide coating and the alumina ceramic arc tube body.

BRIEF DESCRIPTION OF THE DRAWINGS

Many of the attendant advantages of the present invention will become more readily apparent and better understood as the following detailed description is considered in connection with the accompanying drawings, in which.

DESCRIPTION OF THE PREFERRED EMBODIMENTS

Figure 1:
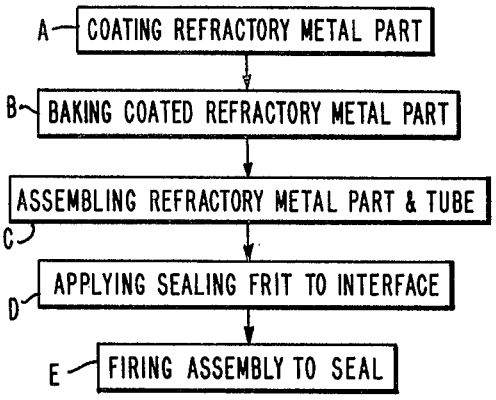
FIG. 1 is a block diagram illustrating the process of the present invention.

Referring now in detail to the drawings wherein like reference characters represent like parts throughout the several views, there is illustrated in FIG. 1 a block diagram depicting the steps required by this process to seal a refractory metal part to an alumina ceramic arc tube. In accordance with the novel process of this invention, a quantity of silicon powder of a size of approximately 325 mesh is mixed with a quantity of refractory metal powder of approximately 325 mesh and a liquid vehicle. The mixture is then ball milled for about 24 hours to provide thorough dispersion. The powder mixture in its liquid vehicle, preferably alcohol or amyl acetate, has a consistency which is somewhere between a thin paste and a viscuous liquid. The viscosity of this slurry may be varied as will be readily apparent to anyone of ordinary skill in the art, depending on whether it is intended to apply the slurry to the refractory metal end cap by painting it on with a brush or spraying it onto the refractory metal surface. Either method has been found to be suitable. The slurry is applied to the refractory metal part, in the preferred embodiment, to the interior surface of a niobium end cap, in an amount of between about 1.8 to 6.0 milligrams per square centimeter of coated surface area. The coated refractory metal part is then baked at from between about 1400° C. to 1600° C. for about 20 to 30 minutes in a vacuum to react the refractory metal powder and silicon powder with each other and the refractory metal end cap and bake off the liquid vehicle.

After the refractory metal part has been prepared, either or both of the refractory metal part and the alumina ceramic part or arc tube, at their interface, are coated with a conventional calcia-alumina sealing frit and the parts are assembled for firing in accordance with a conventional sealing schedule of the type disclosed in U.S. Pat. No. 3,469,729 to R. B. Grekila et al. Such a sealing schedule for example, involves the heating of the assembled arc tube from room temperature to about 700° C. in about 3 minutes, then from 700° C. to between 1425° C. and 1550° C. at a rate of approximately 40° C. per minute for about 20 minutes. The assembly is then held at a temperature of from 1425° to 1550° C. for a period of approximately one minute and thereafter the assembly is cooled at a rate of about 30° C. per minute down to 700° C. at which time the furnace is turned off and the assembly permitted to cool to room temperature. An alternative sealing schedule involves bringing the arc tube from room temperature to 1365°–1400° C. in about 20 to 25 minutes, holding the arc tube at 1365°–1400° C. for about 5 minutes and thereafter reducing the temperature to about 1000° C. in about 12 minutes and holding at the 1000° C. temperature for about 10 minutes. The furnace temperature is then lowered to about 200° C. in 25 minutes at which point the furnace power is shut off and the arc tube permitted to cool to room temperature.

In the situations where a refractory metal end cap is being secured to a tubular polycrystalline alumina or sapphire arc tube body, assembly of the precoated refractory metal end cap to the arc tube body may occur prior to the application of the sealing frit. In this situation, the sealing frit is then applied to an area of the arc tube body adjacent the end of the refractory metal end cap skirt and during the heating cycle the frit will flow to the area between the end cap and the arc tube body by capillary action as is well known in the art of ceramic arc tube manufacture. Whether the alumina-calcia sealing frit is applied to the parts before or after assembly is not critical to the process of the invention.

Figure 2:
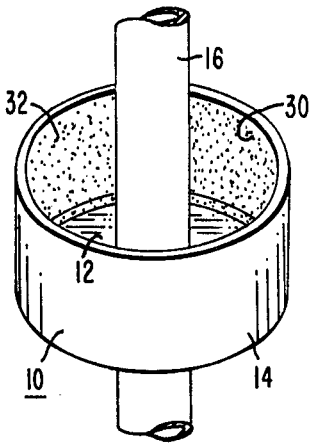
FIG. 2 is a perspective view of a typical end cap for a high pressure sodium discharge lamp.

Several alternative arc tube constructions are employed in the manufacture of high pressure sodium discharge lamps. In all instances a seal must be provided between the polycrystalline alumina or sapphire arc tube and a refractory metal part. One prevalent construction employs refractory metal end caps of the type illustrated in FIG. 2 in connection with the arc tube illustrated in FIG. 3. The end cap 10 generally includes a flat end portion 12 and an annular skirt portion 14 and may include a piece of refractory metal tubulation 16 extending through the center of the flat end portion 12. At least one end of a high pressure sodium discharge lamp arc tube must include tubulation in order to provide for the final filling of the arc tube with the discharge sustaining sodium-mercury amalgam and a suitable starting gas. Although some manufacturers include a tubulation in both ends of the arc tube to provide for uniformity of parts, only one is necessary and in the embodiment illustrated in FIG. 3, the end cap 10 at the right hand end of the arc tube does not include tubulation 16.

Figure 3:
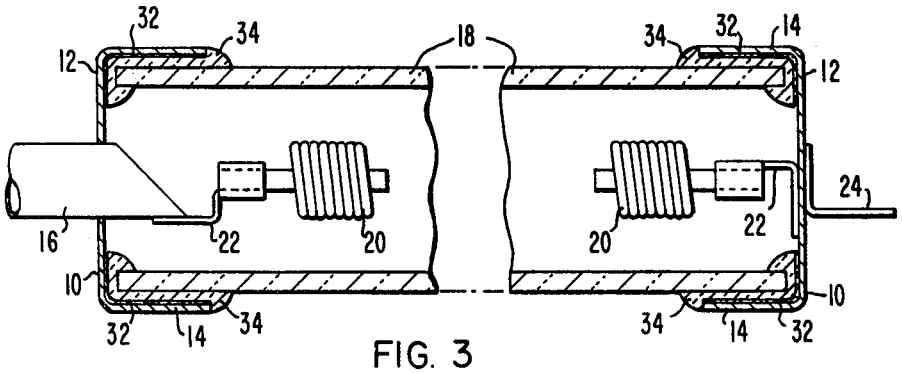
FIG. 3 is a side elevational view partly in section of a typical arc tube for a high pressure sodium discharge lamp.

Referring now to FIG. 3, a typical arc tube for a ceramic discharge lamp includes a tubular polycrystalline alumina or sapphire arc tube body 18 closed off at each end by a refractory metal end cap 10 preferably of niobium. Carried on the end cap assembly are oppositely disposed arc supporting electrodes 20 which are mounted, as illustrated in FIG. 3, to the tubulation of the tubulation carrying end cap by a strap 22 and directly to the non-tubulation carrying end cap by a similar strap 22. A refractory metal lead-in conductor 24 carries current to the right hand electrode as illustrated in FIG. 3 while the niobium tubulation 16, which is brazed to the center of the niobium end cap at 26 carries electrical current to the left hand electrode 20.

In accordance with the present invention, the 0 of the skirt portion 14 of the end cap 10 is coated with the refractory metal powder-silicon powder slurry as well as a portion of the flat end portion 12 of the end cap adjacent to the skirt portion 14. This coating 32 is then baked in a vacuum for about 20 to 30 minutes at between about 1400° C. to 1600° C. The end caps are then placed on the ends of an arc tube body 18 and a sealing frit which principally comprises calcia and alumina in about eutectic proportions, but which may also include small quantities of silica, magnesia, or baria is applied to the intersection of the ends of the end cap skirt portions 14 and the arc tube body about the whole circumference of the arc tube body and the assembly placed in a furnace. This assembly is then heated in accordance with a conventional sealing schedule which causes the glassy sealing frit 34 to flow by capillary action to all those areas of interface between the end cap 10 and the arc tube body 18.

Figure 4:
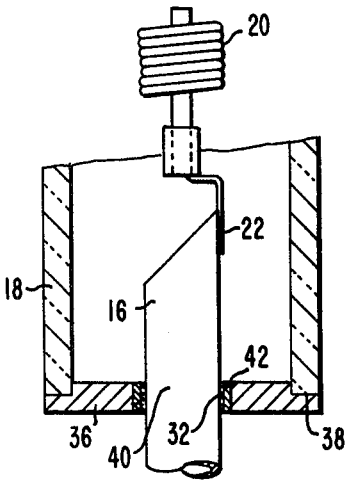
FIG. 4 is a side elevational view partly in section of an alternative construction for one end of a high pressure sodium discharge lamp arc tube.

The process of this invention is also applicable to high pressure sodium discharge lamp arc tubes constructed in accordance with the embodiment illustrated in FIG. 4. In that embodiment, the arc tube body 18 is closed off by a polycrystalline alumina disc 36 which is sealed to the arc body at 38 by any of the conventional sealing frits disclosed in the aforementioned U.S. patents. In this embodiment, a refractory metal, preferably tantalum or niobium tubulation extends through an aperture in the center of the polycrystalline alumina disc 36 and carries on its inner end an electrode support strap 22 and electrode 20. In this embodiment, the slurry of refractory metal powder-silicon powder suspended in a liquid vehicle, for example alcohol or amyl acetate, is coated on the tubulation in the area 40 which is intended to interface with the aperture in the ceramic end cap 36 in the same manner as it was applied to the interior surface of the end cap 10. The coated tubulation is then baked in a vacuum at from between about 1400°

C. and 1600° C. for about 20 to 30 minutes before assembly with the ceramic end disc 36 again by means of a conventional calcia-alumina sealing frit at 42.

It should be also noted that varying amounts of the calcia-alumina sealing frit material may be mixed with the refractory-metal-silicon metal powder slurry before the slurry is applied to the refractory metal part. Lamps have been successfully sealed with slurry and frit combinations ranging from 90% slurry and 10% frit to 10% slurry and 90% frit. When such mixtures are employed it has been found to be preferable that the ratio of slurry to frit should be on the order of about 80% slurry and 20% glassy sealing frit.

Figure 5:
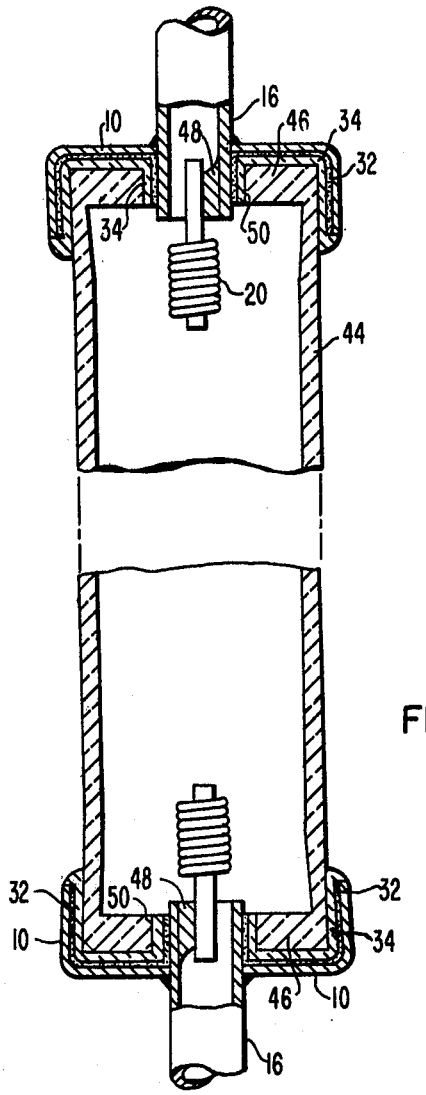
FIG. 5 is a side elevational view, partly in section of yet another embodiment of an arc tube for a high pressure sodium discharge lamp employing this invention.

A new arc tube construction, disclosed and claimed in copending application Ser. No. 036,949, filed the same day as this application by R. S. Bhalla and V. L. Plagge, and owned by the assignee of this invention is illustrated in FIG. 5. In that construction, a monolithic arc tube body 44 having semi-closed ends at 46 of uniform polycrystalline alumina construction has only small apertures 50 through the ends which are adapted to receive the conventional refractory metal, preferably niobium, tubulation 16 which has the electrodes 20 welded thereto at 48. The niobium end cap 10 constituting the remainder of the subassembly has the refractory metal silicide coating 32 deposited, in this configuration, on the entire interior end cap surface along with that portion of the tubulation 16 which extends through the aperture 50 in the end portion 46 of the monolithic arc tube 44. As in the other embodiments, a conventional calcia-alumina sealing frit is employed to seal the end cap-tubulation subassembly to the arc tube body and is located between all of the coated metal surfaces of the interior of the end cap and tubulation and the portions of the polycrystalline alumina arc tube body which interface therewith. As will be apparent in this embodiment, a much larger seal path is provided at the interface between the metallic parts and the polycrystalline alumina arc tube body and produces a lamp which is operable at much higher temperatures, without seal failure, and hence can produce an improved color rendering sodium discharge lamp.

The refractory metal silicide coating of this invention is produced by ball milling a mixture of refractory powder and silicon metal powder in a liquid vehicle, preferably amyl acetate or alcohol for a period of 24 hours. The refractory metal powder and the silicon powder is preferably of 325 mesh and the refractory metal powder can be any of niobium, tantalum, tungsten and molybdenum. Successful seal improvement has been accomplished with the ratio of refractory powder to silicon powder being from 80% refractory metal powder to 20% silicon powder to 10% refractory metal powder and 90% silicon powder. In the preferred embodiment, about 30% refractory metal powder is employed with 70% silicon metal powder. Peel strength tests were accomplished employing a 4 mm wide niobium strip joined to a polycrystalline alumina body with a conventional sealing frit. When no adhesion promoting coating was used, the peel strength was only 0.025 pounds, with a silicon coating on the niobium strip, the better samples had a peel strength of 2.8 pounds whereas coatings of refractory metal silicides using 30% refractory metal powder and 70% silicon powder to produce the refractory metal silicide coating evidenced the following peel strengths:

| Test Number | Refractory Metal Mixture | Maximum Peel Strength |
|---|---|---|
| 1 | 30% Nb/70% Si | 17.8 lbs. |
| 2 | 30% Ta/70% Si | 17.2 lbs. |
| 3 | 30% W/70% Si | 15.1 lbs. |
| 4 | 30% Mo/70% Si | 20.4 lbs. |
| 5 | Pure Si | 2.8 lbs. |

The foregoing clearly illustrates the significant adhesion promotion which occurs when a refractory metal silicide coating is provided on the niobium surface which is intended to be sealed to a polycrystalline alumina body with a calcia-alumina glassy sealing frit.

Lamps employing a refractory metal silicide coating on the niobium end cap produced from a 30% niobium metal powder and 70% silicon powder mixture have been tested in excess of 1000 hours with no seal failures.

As will be apparent from the foregoing, the sealing process of this invention has provided significantly improved seals between the niobium end caps and the polycrystalline alumina body of the arc tube in high pressure sodium discharge lamps.

What is claimed is:

1. A sealed high pressure sodium discharge lamp arc tube, said arc tube comprising:

an elongated alumina arc tube body;

a refractory metal end cap associated with each end of said arc tube body; and means sealing said end caps to the ends of said arc tube body, said means sealing said end caps to said ends of said arc tube body including a coating of a refractory metal silicide on the interior surface of said refractory metal end caps and a glassy sealing frit principally comprising alumina and calcia interposed between said refractory metal silicide coating and said alumina arc tube body.

2. The sealed high pressure sodium discharge lamp arc tube according to claim 1, wherein said alumina arc tube body is polycrystalline alumina and said refractory metal end cap is niobium.

3. An arc tube for a high pressure sodium discharge lamp comprising:

an elongated tubular ceramic arc tube body member;

a pair of refractory metal end caps having a refractory metal silicide coating on the interior surface thereof sealed to and closing off the ends of said elongated tubular ceramic arc tube body member.

4. The arc tube according to claim 3 wherein said refractory metal end caps are niobium.

5. A sealed high pressure sodium discharge lamp arc tube, said arc tube comprising:

an elongated monolithic alumina arc tube body having circular apertures in the ends thereof of a diameter substantially less than the diameter of the arc tube body;

a refractory metal end cap having a refractory metal tubulation extending through the center thereof associated with each end of said arc tube body, with said tubulation extending through said small diameter aperture; and means sealing said end caps and tubulation to the ends of said arc tube body, said means sealing said end caps and tubulation to said ends of said arc tube body including a coating of a refractory metal silicide on the interior surface of said refractory metal end caps and the surface of said tubulation extending through said small diameter aperture in said arc tube body and a glassy sealing frit principally comprising alumina and calcia interposed between said refractory metal silicide coating and said alumina arc tube body.

6. The sealed high pressure sodium discharge lamp arc tube body according to claim 5 wherein said alumina arc tube body is polycrystalline alumina and said refractory metal end caps and tubulations are niobium.

7. The sealed high pressure sodium discharge lamp arc tube according to claims 1, 3 or 5 wherein said refractory metal silicide is niobium silicide with the ratio of niobium to silicon being about 3 to 7.

* * * * *